US010056096B2

(12) United States Patent
Yoo

(10) Patent No.: US 10,056,096 B2
(45) Date of Patent: Aug. 21, 2018

(54) ELECTRONIC DEVICE AND METHOD CAPABLE OF VOICE RECOGNITION

(71) Applicant: SAMSUNG ELECTRONICS CO., LTD., Suwon-si (KR)

(72) Inventor: Jong-uk Yoo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/216,829

(22) Filed: Jul. 22, 2016

(65) Prior Publication Data

US 2017/0084292 A1 Mar. 23, 2017

(30) Foreign Application Priority Data

Sep. 23, 2015 (KR) ..... 10-2015-0134746

(51) Int. Cl.

| | |
|---|---|
| ***G10L 25/84*** | (2013.01) |
| ***G10L 25/18*** | (2013.01) |
| ***G10L 25/09*** | (2013.01) |
| ***G10L 25/78*** | (2013.01) |

(52) U.S. Cl.

CPC ..... *G10L 25/84* (2013.01); *G10L 25/09* (2013.01); *G10L 25/18* (2013.01); *G10L 2025/783* (2013.01)

(58) Field of Classification Search

None

See application file for complete search history.

(56) References Cited

U.S. PATENT DOCUMENTS

| | | | | |
|---|---|---|---|---|
| 5,596,680 | A * | 1/1997 | Chow | G10L 25/87 704/248 |
| 5,848,388 | A * | 12/1998 | Power | G10L 17/02 704/239 |
| 8,990,073 | B2 * | 3/2015 | Malenovsky | G10L 25/78 381/94.3 |
| 8,990,074 | B2 * | 3/2015 | Duni | G10L 25/93 340/572.4 |
| 9,401,160 | B2 * | 7/2016 | Sehlstedt | G10L 25/78 |
| 2002/0111798 | A1 * | 8/2002 | Huang | G10L 19/22 704/220 |
| 2003/0110029 | A1 * | 6/2003 | Ahmadi | G10L 21/0208 704/233 |

(Continued)

*Primary Examiner* — Paras D Shah
*Assistant Examiner* — Jonathan Kim
(74) *Attorney, Agent, or Firm* — Sughrue Mion, PLLC

(57) ABSTRACT

Provided herein is an electronic device and method of voice recognition, the method including analyzing an audio signal of a first frame when the audio signal is input and extracting a first feature value; determining a similarity between the first feature value extracted from the audio signal of the first frame and a first feature value extracted from an audio signal of a previous frame; analyzing the audio signal of the first frame and extracting a second feature value when the similarity is below a predetermined threshold value; and comparing the extracted first feature value and the second feature value and at least one feature value corresponding to a pre-defined voice signal and determining whether or not the audio signal of the first frame is a voice signal, and thus the electronic device may detect only a voice section from the audio signal while improving the processing speed.

19 Claims, 10 Drawing Sheets

(56) References Cited

U.S. PATENT DOCUMENTS

2004/0193419 A1* 9/2004 Kimball ..... G10L 25/48 704/256
2005/0216261 A1* 9/2005 Garner ..... G10L 25/87 704/215
2007/0260455 A1* 11/2007 Akamine ..... G10L 15/20 704/233
2009/0125305 A1* 5/2009 Cho ..... G10L 25/78 704/233
2009/0192803 A1* 7/2009 Nagaraja ..... G10L 19/012 704/278
2010/0211385 A1* 8/2010 Sehlstedt ..... G10L 25/78 704/214
2010/0268532 A1* 10/2010 Arakawa ..... G10L 25/93 704/214
2011/0075851 A1* 3/2011 LeBoeuf ..... H04R 29/00 381/56
2012/0123772 A1* 5/2012 Thyssen ..... G10L 21/0208 704/226
2012/0166194 A1* 6/2012 Jung ..... G10L 15/02 704/238
2012/0197642 A1* 8/2012 Liu ..... G10L 25/78 704/237
2012/0215536 A1* 8/2012 Sehlstedt ..... G10L 25/78 704/246
2012/0221330 A1* 8/2012 Thambiratnam ..... G10L 25/84 704/235
2012/0237042 A1* 9/2012 Hirohata ..... G10L 25/78 381/56
2012/0303362 A1* 11/2012 Duni ..... G10L 19/22 704/219
2013/0211831 A1* 8/2013 Kumagai ..... G10L 21/0208 704/226
2013/0223635 A1* 8/2013 Singer ..... H04R 1/1041 381/56
2014/0012573 A1* 1/2014 Hung ..... G06F 1/3215 704/233
2014/0108020 A1* 4/2014 Sharma ..... G10L 19/018 704/500
2014/0222436 A1* 8/2014 Binder ..... G06F 3/167 704/275
2015/0051906 A1* 2/2015 Dickins ..... G10L 25/78 704/210
2015/0106088 A1* 4/2015 Jarvinen ..... G10L 21/0208 704/233
2015/0351028 A1* 12/2015 Vallath ..... H04W 52/0209 370/311
2016/0275968 A1* 9/2016 Terao ..... G10L 25/84
2017/0004840 A1* 1/2017 Jiang ..... G10L 25/78
2017/0069331 A1* 3/2017 Sehlstedt ..... G10L 25/78

* cited by examiner

ELECTRONIC DEVICE AND METHOD CAPABLE OF VOICE RECOGNITION

CROSS-REFERENCE TO RELATED APPLICATIONS

This application claims priority from Korean Patent Application No. 10-2015-0134746, filed on Sep. 23, 2015, in the Korean Intellectual Property Office, the disclosure of which is incorporated herein by reference in its entirety.

BACKGROUND

I. Field

Apparatuses and methods consistent with the present disclosure relate to an electronic device and method capable of voice recognition, and more particularly, to an electronic device and method capable of detecting a voice section from an audio signal.

II. Description of the Related Art

The technique of controlling various electronic devices using voice signals is being widely used. In general, a voice recognition technique refers to a technique of, when a voice signal is input into a software device, a hardware device, or a system, identifying an intention of an uttered voice of a user from the input voice signal, and of performing an operation accordingly.

However, such a technique may have a problem that not only a voice signal of the uttered voice of the user but also other various sounds generated in its peripheral environment may be recognized, and thus the operation intended by the user may not be performed properly.

Therefore, various voice section detection algorithms for detecting only a voice section with respect to the uttered voice of a user from an input audio signal are being developed.

General voice section detecting methods include a method for detecting a voice section using the energy of each audio signal of frame units, a method for detecting a voice section using a zero crossing ratio of each audio signal of frame units, and a method for extracting a feature vector from an audio signal of frame units and then determining whether or not an audio signal per frame is a voice signal from a pre-extracted feature vector using an SVM (Support Vector Machine).

The method of detecting a voice section using the energy or the zero crossing ratio of an audio signal of frame units uses the energy or the zero crossing ratio of an audio signal per frame. Therefore, such a conventional voice section detection method may have relatively less computations for determining whether or not an audio signal per frame is a voice signal, but there may be a problem that an error may occur as a voice section may be detected not only for a voice signal but also for a noise signal.

Meanwhile, the method for detecting a voice section using a feature vector extracted from an audio signal of frame units and SVM has more precision in detecting only a voice signal from an audio signal per frame compared to the aforementioned method for detecting a voice section using the energy or zero crossing ratio, but since it takes a lot of computation amount for determining whether or not an audio signal is a voice signal, there may be a problem that a lot of CPU resources are consumed compared to other voice section detection methods.

SUMMARY

Therefore, the present disclosure was conceived from the aforementioned need, that is, to properly detect a voice section including a voice signal from an audio signal input into an electronic device.

Furthermore, a purpose of the present disclosure is to improve the processing speed related to detecting a voice section by minimizing the computation amount necessary for detecting the voice section from an audio signal input into an electronic device.

According to an exemplary embodiment of the present disclosure, a voice recognition method of an electronic device is provided, the method may include analyzing an audio signal of a first frame when the audio signal of the first frame is input into the electronic device using an inputter of the electronic device, and extracting a first feature value using a processor of the electronic device; determining a similarity between the first feature value extracted from the audio signal of the first frame and a first feature value extracted from an audio signal of a previous frame using the processor; analyzing the audio signal of the first frame and extracting a second feature value when the similarity is below a predetermined threshold value using the processor; and comparing the extracted first feature value and the second feature value and at least one feature value corresponding to a pre-defined voice signal and determining whether or not the audio signal of the first frame is a voice signal using the processor.

Furthermore, the audio signal of the previous frame may be a voice signal, and the determining whether or not the audio signal of the first frame is a voice signal may involve determining that the audio signal of the first frame is a voice signal when the similarity between the first feature value of the first frame and the first feature value of the previous frame is equal to or above the predetermined first threshold value.

Furthermore, the determining whether or not the audio signal of the first frame is a voice signal may include comparing a similarity between at least one of the first feature value and the second feature value and at least one feature value corresponding to the pre-defined voice signal with a predetermined second threshold value using the processor, when the similarity between the first feature value of the first frame and the first feature value of the previous frame is below the predetermined first threshold value; and determining that the audio signal of the first frame is a noise signal when the similarity is below the predetermined second threshold value, wherein the second threshold value may be adjusted depending on whether or not the audio signal of the previous frame is a voice signal.

Furthermore, the audio signal of the previous frame may be a noise signal, and the determining whether or not the audio signal of the first frame is a voice signal may involve determining that the audio signal of the first frame is a noise signal when the similarity between the first feature value of the first frame and the first feature value of the previous frame is equal to or above the predetermined first threshold value.

Furthermore, the determining whether or not the audio signal of the first frame is a voice signal may include comparing the similarity between at least one of the first feature value and the second feature value and at least one feature value corresponding to the pre-defined voice signal with a predetermined second threshold value using the processor when the similarity between the first feature value of the first frame and the first feature value of the previous frame is below the predetermined first threshold value; and determining that the audio signal of the first frame is a voice signal when the similarity is equal to or above the predetermined second threshold value. The second threshold value may be adjusted according to whether or not the audio signal of the previous frame is a voice signal.

Furthermore, the determining whether or not the audio signal of the first frame is a voice signal may involve, when the audio signal of the first frame is an initially input audio signal, computing a similarity between at least one of the first feature value and the second feature value of the first frame and at least one feature value corresponding to the voice signal using the processor, and comparing the computed similarity with the first threshold value using the processor, and when the similarity is equal to or above the first threshold value, determining the first frame as a voice signal. Furthermore, the first feature value may be at least one of Mel-Frequency Cepstral Coefficients (MFCC), Roll-off and band spectrum energy.

The second feature value may be at least one of Low energy ratio, Zero crossing rate, Spectral flux, and Octave band energy.

Furthermore, the determining whether or not the audio signal of the first frame is a voice signal may involve, when it is determined that the audio signal of the first frame is a voice signal, classifying a speaker with respect to the audio signal of the first frame based on the extracted first feature value and the second feature value and a feature value corresponding to a pre-defined voice signal.

According to an exemplary embodiment of the present disclosure, an electronic device capable of voice recognition is provided, the device may include an inputter configured to receive an input of an audio signal; a memory configured to store at least one feature value corresponding to a pre-defined voice signal; and a processor configured to: when an audio signal of a first frame is input, analyze the audio signal of the first frame and extract a first feature value; analyze the audio signal of the first frame and extract a second feature value when a similarity between the first feature value extracted from the audio signal of the first frame and a first feature value extracted from an audio signal of a previous frame is below a predetermined threshold value; and compare the extracted first feature value and the second feature value with a feature value corresponding to a voice signal stored in the memory and determine whether or not the audio signal of the first frame is a voice signal.

Furthermore, the audio signal of the previous frame may be a voice signal, and the processor may determine that the audio signal of the first frame is a voice signal when the similarity between the first feature value of the first frame and the first feature value of the previous frame is equal to or above a predetermined first threshold value.

Furthermore, when the similarity between the first feature value of the first frame and the first feature value of the previous frame is below the predetermined first threshold value, the processor may compare a similarity between at least one of the first feature value and the second feature value and at least one feature value corresponding to the pre-defined voice signal with a predetermined second threshold value, and when the similarity is below the predetermined second threshold value, the processor may determine that the audio signal of the first frame is a noise signal, and the second threshold value may be adjusted depending on whether or not the audio signal of the previous frame is a voice signal.

Furthermore, the audio signal of the previous frame may be a noise signal, and the processor may determine that the audio signal of the first frame is a noise signal when the similarity between the first feature value of the first frame and the first feature of the previous frame is equal to or above a predetermined first threshold value.

Furthermore, when the similarity between the first feature value of the first frame and the first feature of the previous frame is below the predetermined first threshold value, the processor may compare a similarity between at least one of the first feature value and the second feature value and at least one feature value corresponding to a pre-defined voice signal with a predetermined second threshold value, and when the similarity is equal to or above the predetermined second threshold value, determine that the audio signal of the first frame is a voice signal, and the second threshold value may be adjusted depending on whether or not the audio signal of the previous frame is a voice signal.

Furthermore, when the audio signal of the first frame is an initially input audio signal, the processor may compute a similarity between at least one of the first feature value and the second feature value of the first frame and at least one feature value corresponding to the voice signal, and compare the computed similarity with the first threshold value, and when the similarity is equal to or above the first threshold value, determine the first frame as a voice signal.

Furthermore, the first feature value may be at least one of MFCC, Roll-off, and band spectrum energy.

Furthermore, the second feature value may be at least one of Low energy ratio, Zero crossing rate, Spectral flux, and Octave band energy.

Furthermore, when it is determined that the audio signal of the first frame is a voice signal, the processor may classify a speaker with respect to the audio signal of the first frame based on the extracted first feature value and the second feature value and a feature value corresponding to a pre-defined voice signal.

According to an exemplary embodiment of the present disclosure, there is provided a computer program combined with an electronic device and stored in a record medium in order to execute steps of: analyzing an audio signal of a first frame when the audio signal of the first frame is input into the electronic device using an inputter of the electronic device, and extracting a first feature value using a processor of the electronic device; determining a similarity between the first feature value extracted from the audio signal of the first frame and a first feature value extracted from an audio signal of a previous frame using the processor; analyzing the audio signal of the first frame and extracting a second feature value when the similarity is below a predetermined threshold value using the processor; and comparing the extracted first feature value and the second feature value and a feature value corresponding to a pre-defined voice signal, and determining whether or not the audio signal of the first frame is a voice signal using the processor.

According to the aforementioned various exemplary embodiments of the present disclosure, the electronic device may detect only a voice section from an audio signal properly while improving the processing speed related to voice section detection.

BRIEF DESCRIPTION OF THE DRAWING FIGURES

The above and/or other aspects of the present disclosure will be more apparent by describing certain exemplary embodiments of the present disclosure with reference to the accompanying drawings, in which.

Figure 9:
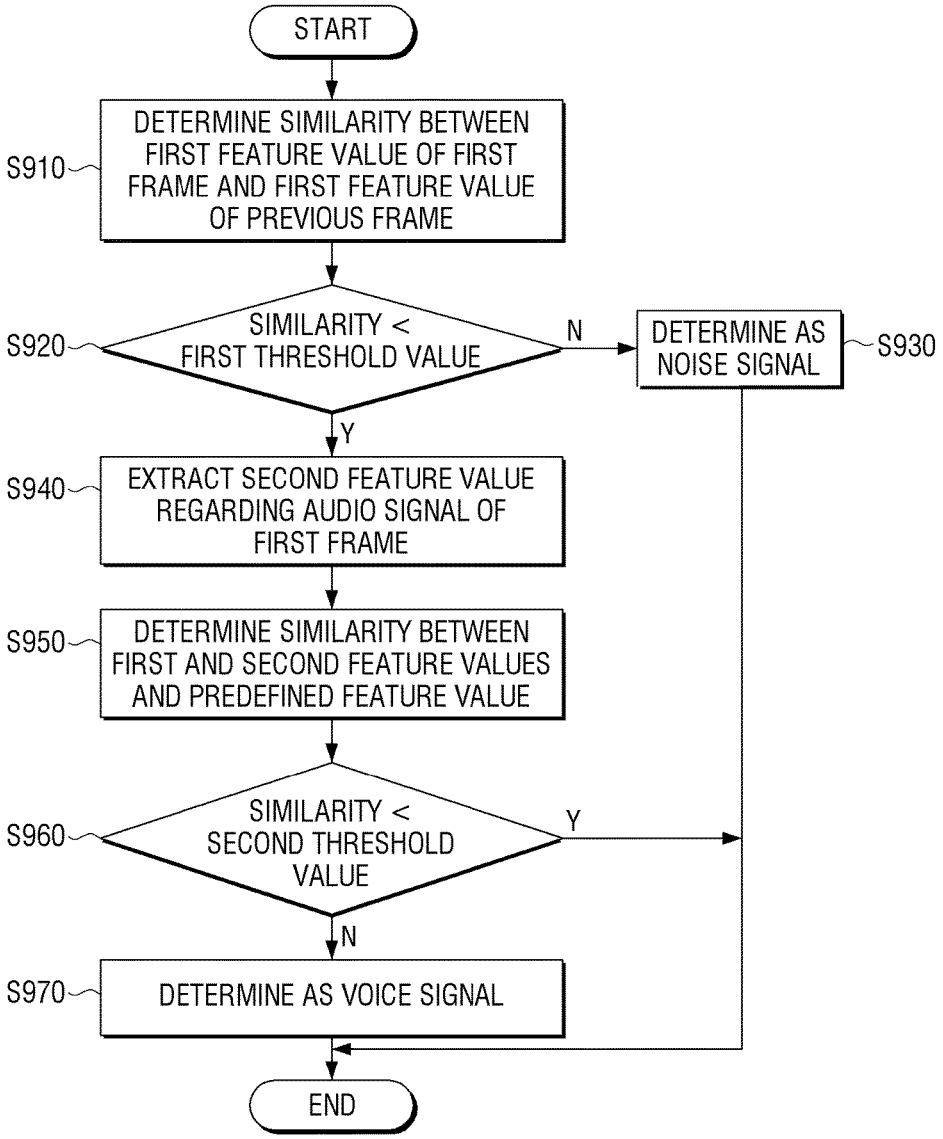
Figure 10:
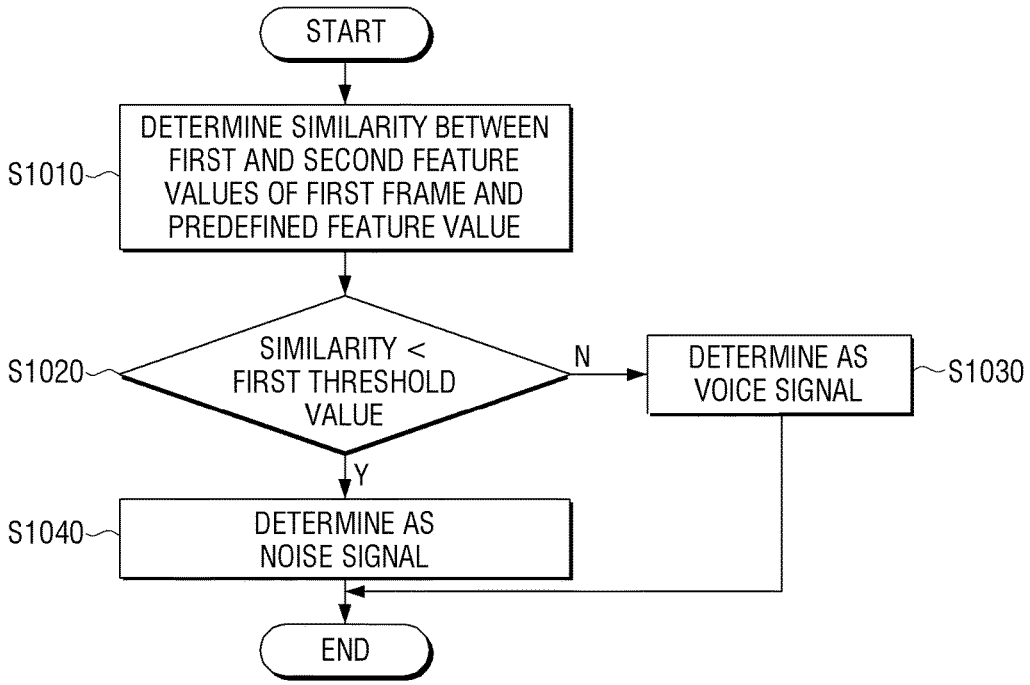

FIG. 9 is a flowchart for determining whether or not an audio signal of a frame input into an electronic device is a voice signal according to an exemplary embodiment of the present disclosure; and FIG. 10 is a flowchart for determining whether or not an audio signal of a frame initially input into an electronic device is a voice signal according to an exemplary embodiment of the present disclosure.

DETAILED DESCRIPTION OF EXEMPLARY EMBODIMENTS

Prior to explaining the present disclosure in detail, explanation will be made on the manner in which the present disclosure and drawings thereof are described.

First of all, the terms used in the present specification and in the claims are general terms selected in consideration of functions in various embodiments of the present disclosure. However, these terms may have different meanings depending on intentions of those skilled in the related art, technological interpretation, and emergence of a new technology and the like. Furthermore, some of them are terms selected arbitrarily by the applicant. Those terms may be construed as defined in the present specification, and unless defined specifically, may be construed based on common technical knowledge of the related art.

Furthermore, throughout the specification, like reference numerals indicate components or parts performing like functions. For convenience sake, like reference numerals are used in different embodiments. That is, even when a plurality of drawings illustrate all the components having like reference numerals, it does not mean that the plurality of drawings indicate one embodiment.

Furthermore, in the present specification and claims, terms that include ordinal numbers such as "first", "second" and the like may be used to differentiate between components. These ordinal numbers are used to differentiate between identical or similar components, and use of these ordinal numbers does not limit the meaning of the terms. For example, a component combined with such an ordinal number is not limited to a certain order of use or order of arrangement by the ordinal number. If necessary, the ordinal numbers may be used in different orders.

In the present specification, a singular expression includes a plural expression unless clearly stated otherwise. In the present application, terms such as "include", "comprise" and the like should be construed as indicating that a characteristic, number, step, operation, component, part, or a combination thereof exists, and should not be construed as excluding the possibility of existence or addition of one or more other characteristics, numbers, steps, components, parts, or combination thereof.

In the embodiments of the present disclosure, terms such as the "module", "unit", "part" and the like are terms used to indicate components that perform at least one function or operation, and these components may be realized as hardware, software or combination thereof. Furthermore, a plurality of "modules", "units", "parts" and the like may each be integrated in at least one module or chip to be realized as at least one processor (not illustrated), unless there is a need to be realized as certain hardware.

Furthermore, one component (for example: a first component) being operatively or communicatively coupled or connected to another component (for example: a second component) should be understood as including cases where the component is indirectly connected, or indirectly connected through another component (for example: a third component). On the other hand, one component (for example: a first component) being "directly connected" or "directly coupled" to another component (for example: a second component) should be understood as a case where there is no other component (for example: a third component) between those components.

Hereinafter, various exemplary embodiments of the present disclosure will be explained in detail with reference to the drawings attached.

Figure 1:
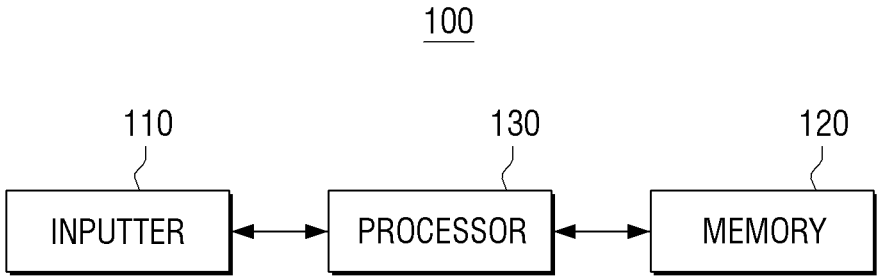
FIG. 1 is a block diagram schematically illustrating an electronic device capable of voice recognition according to an exemplary embodiment of the present disclosure.
Figure 2:
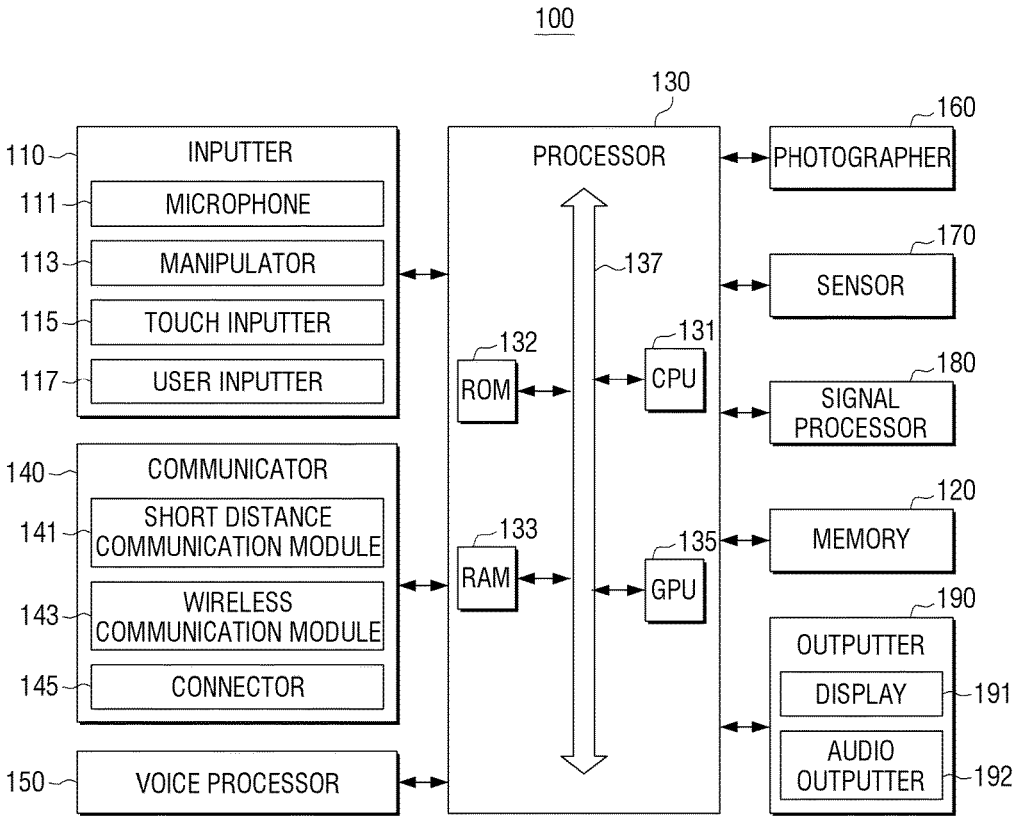
FIG. 2 is a block diagram illustrating in detail an electronic device capable of voice recognition according to an exemplary embodiment of the present disclosure.

FIG. 1 is a block diagram schematically illustrating an electronic device capable of voice recognition according to an exemplary embodiment of the present disclosure, and FIG. 2 is a block diagram illustrating in detail the electronic device capable of voice recognition according to an exemplary embodiment of the present disclosure.

As illustrated in FIG. 1, the electronic device 100 includes an inputter 110, a memory 120, and a processor 130.

The inputter 110 receives an audio signal of frame units, and the memory 120 stores at least one feature value corresponding to a pre-defined voice signal.

Furthermore, when an audio signal of a first frame is input through the inputter 110, the processor 130 analyzes the audio signal of the first frame and extracts a first feature value. Then, the processor 130 analyzes a similarity between the first feature value extracted from the audio signal of the first frame and a first feature value extracted from an audio signal of a previous frame. That is, when the similarity between the first feature value extracted from the audio signal of the first frame and the first feature value extracted from the previous frame is below a predetermined threshold value (hereinafter, referred to as a "first threshold value"), the processor 130 analyzes the audio signal of the first frame and extracts a second feature value.

Thereafter, the processor 130 determines whether the audio signal of the first frame is a voice signal or a noise signal by comparing the extracted first feature value and the second feature value with at least one feature value corresponding to a voice signal pre-stored in the memory 120. Through this process, the processor 130 may detect only a voice section uttered by a user among audio signals input through the inputter 110.

Specifically, as illustrated in FIG. 2, the inputter 110 may include a microphone 111 through which the inputter 110 may receive an audio signal that includes a voice signal of a voice uttered by the user. In some embodiments, the microphone 111 may receive the audio signal when it is activated as power is supplied to the electronic device 100 or a user command to recognize the user's uttered voice is input. When the audio signal is input, the microphone 111 may divide the input audio signal into frames of predetermined time units and output the divided frames to the processor 130.

When an audio signal of a first frame among audio signals of a plurality of frames is input, the processor 130 analyzes the audio signal of the first frame and extracts a first feature value. In this case, the first feature value may be at least one of Mel-Frequency Cepstral Coefficients (MFCC), Centroid, Roll-off, and band spectrum energy.

In this case, the MFCC is one way of expressing a power spectrum of an audio signal of frame units, that is, a feature vector obtained by taking a Cosine Transform to a log power spectrum in a frequency domain of a nonlinear Mel scale.

The Centroid is a value representing a central value of frequency components in a frequency area with respect to an audio signal of frame units, and the Roll-off is a value representing a frequency area that includes 85% of frequency components of a frequency area of an audio signal of frame units. Furthermore, the Band Spectrum Energy is a value representing how much energy is spread in a frequency band of an audio signal of frame units. Such a first feature value is a well known technique and thus detailed explanation thereof is omitted.

As aforementioned, when the audio signal of the first frame is analyzed and the first feature value is extracted, the processor 130 computes a similarity between the first feature value extracted from the audio signal of the first frame and the first feature value extracted from the audio signal of the previous frame.

The similarity between the first feature value extracted from the audio signal of the first frame and the first feature value extracted from the audio signal of the previous frame may be computed using a cosine similarity algorithm such as <Math Equation 1> below.

similarity= [Math Equation 1]

$$\cos(\theta) = \frac{A \cdot B}{\|A\|\|B\|} = \frac{\sum_{i=1}^{n} A_i \times B_i}{\sqrt{\sum_{i=1}^{n} (A_i)^2} \times \sqrt{\sum_{i=1}^{n} (B_i)^2}}$$

In this case, A may be the first feature value extracted from the audio signal of the previous frame, and B may be the first feature value extracted from the audio signal of the first frame which is the current frame.

When the similarity between the first frame and the previous frame is computed using such a cosine similarity algorithm, and the computed similarity is below a predetermined first threshold value, the processor 130 analyzes the audio signal of the first frame and extracts a second feature value.

In an embodiment, a maximum value of the similarity may be 1, a minimum value of the similarity may be 0, and the first threshold value may be 0.5. Therefore, when the similarity between the first frame and the previous frame is below 0.5, the processor 130 may determine that the first frame and the previous frame are not similar to each other and thus determine that the audio signal of the first frame is a signal of an event occurred. Meanwhile, when the similarity between the first frame and the previous frame is equal to or above 0.5, the processor 130 may determine that the first frame and the previous frame are similar to each other, and thus determine that the audio signal of the first frame is a signal of no event occurred.

In an embodiment, the audio signal of the previous frame may be a signal detected as a noise signal.

In this case, when the similarity between the first frame and the previous frame is equal to or above the predetermined first threshold value, the processor 130 may determine that the audio signal of the first frame is a noise signal. However, when the similarity between the first frame and the previous frame is below the predetermined first threshold value, the processor 130 determines that the audio signal of the first frame is a signal of an event occurred. When it is determined that the audio signal of the first frame is a signal of an event occurred, the processor 130 analyzes the audio signal of the first frame and extracts a second feature value. In this case, the second feature value may be at least one of a Low energy ratio, Zero crossing rate, Spectral flux, and Octave band energy.

The Low energy ratio represents a low energy ratio of an audio signal of frame units to a frequency band, and the Zero crossing rate represents an extent by which an audio signal value of frame units is crossed by a positive number and negative number on a time domain. The Spectral flux represents a difference between frequency components of a current frame and a previous frame adjacent to the current frame or a subsequent frame, and the Octave band energy represents an energy of a high frequency component in a frequency band with respect to an audio signal of frame units. Such a second feature value is a well know technique, and thus detailed explanation thereof is omitted herein.

When the second feature value is extracted from the audio signal of the first frame, the processor 130 determines whether or not the audio signal of the first frame is a voice signal by comparing at least one of the first feature value and the second feature value pre-extracted from the audio signal of the first frame with at least one feature value corresponding to a voice signal pre-stored in the memory 120.

Specifically, the memory 120 may store a predetermined feature value corresponding to each of a variety of signals including voice signals. Therefore, the processor 130 may determine whether the audio signal of the first frame is a voice signal or a noise signal by comparing at least one feature value corresponding to a voice signal pre-stored in the memory 120 with at least one of the first feature value and the second feature value extracted from the audio signal of the first frame.

That is, the processor 130 computes a similarity between at least one of the first feature value and the second feature value extracted from the audio signal of the first frame and at least one feature value corresponding to the pre-stored voice signal. The similarity between at least one of the first feature value and the second feature value pre-extracted from the audio signal of the first frame and the at least one feature value corresponding to the pre-stored voice signal may be computed from <Math Equation 1>. When such a similarity is computed, the processor 130 may determine whether or not the audio signal of the first frame is a voice signal by comparing the computed similarity with a predetermined second threshold value. In this case, the second threshold value may be adjusted depending whether or not the audio signal of the previous frame is a voice signal.

As aforementioned, when the audio signal of the previous frame is a noise signal, the second threshold value may be adjusted to have an identical or lower value than the first threshold value.

With the second threshold value adjusted as aforementioned, the processor 130 compares the second threshold value with the similarity between at least one of the first feature value and the second feature value of the audio signal of the first frame and at least one feature value corresponding to the pre-stored voice signal. When the similarity is equal to or above the second threshold value as a result of comparison, the audio signal of the first frame may be determined as a voice signal.

On the other hand, when the similarity between at least one of the first feature value and the second feature value of the audio signal of the first frame and at least one feature value corresponding to the pre-stored voice signal is below the second threshold value, the processor 130 may determine that the audio signal of the first frame is a noise signal.

Once it is determined that the audio signal of the first frame is a voice signal or a noise signal, the processor 130 may determine whether an audio signal of a second frame that is input sequentially after the first frame is a voice signal or a noise signal through the aforementioned process.

In another embodiment, the audio signal of the previous frame may be a signal detected as a voice signal.

In this case, when the similarity between the first frame and the previous frame is equal to or above the predetermined first threshold value, the processor 130 determines that the audio signal of the first frame is a signal of no event occurred. When it is detected that the audio signal of the first frame is not an event signal with the audio signal of the previous frame detected as a voice signal as aforementioned, the processor 130 may determine that the audio signal of the first frame is a voice signal.

That is, when the audio signal of the first frame is detected as a signal of no event occurred with the audio signal of the previous frame detected as a voice signal, the processor 130 may extract a second feature value from the audio signal of the first frame as aforementioned, and then omit the operation of determining whether the audio signal of the first frame is a voice signal based on the extracted first and second feature values.

Meanwhile, when the similarity between the first frame and the previous frame is below the predetermined first threshold value, the processor 130 may determine that the audio signal of the first frame is a signal of an event occurred. When the audio signal of the first frame is detected as an event signal with the audio signal of the previous frame detected as a voice signal as aforementioned, the processor 130 analyzes the audio signal of the first frame and extracts the second feature value.

Then, the processor 130 computes the similarity between at least one of the first feature value and the second feature value pre-extracted from the audio signal of the first frame and at least one feature value corresponding to the pre-stored voice signal. Then, the processor 130 compares the computed similarity with the predetermined second threshold value, and when the pre-computed similarity is below the second threshold value, the processor 130 may determine that the audio signal of the first frame is a noise signal, and when the computed similarity is equal to or above the second threshold value, the processor 130 may determine that the audio signal of the first frame is a voice signal.

In this case, the second threshold value may be adjusted depending on whether or not the audio signal of the previous frame is a voice signal. In the case where the audio signal of the previous frame is a voice signal as aforementioned, the second threshold value may be adjusted to have a greater value than the first threshold value.

With the second threshold value adjusted as aforementioned, the processor 130 compares the second threshold value with the similarity between at least one of the first feature value and the second feature value of the audio signal of the first frame and at least one feature value corresponding to the pre-stored voice signal. When the similarity is below the second threshold value as a result of comparison, the processor 130 may determine that the audio signal of the first frame is a noise signal.

On the other hand, when the similarity between at least one of the first feature value and the second feature value of the audio signal of the first frame and at least one feature value corresponding to the pre-stored voice signal is equal to or above the second threshold value, the processor 130 may determine that the audio signal of the first frame is a voice signal.

Meanwhile, the audio signal of the first frame may be an initially input audio signal.

In this case, the processor 130 extracts the first feature value from the initially input audio signal of the first frame. Thereafter, the processor 130 determines a similarity between the first feature value extracted from the audio signal of the first frame and a pre-defined reference value. In this case, the pre-defined reference value may be a feature value set with respect to a voice signal.

Furthermore, determination of the similarity between the first feature value extracted from the audio signal of the first frame and the pre-defined reference value may be performed in the same manner as in the determination made of the similarity between the aforementioned first frame and the previous frame.

That is, the processor 130 may compute the similarity between the first feature value extracted from the audio signal of the first frame and the pre-defined reference value based on the aforementioned <Math Formula 1>, and compares the computed similarity with the first threshold value. When the similarity is equal to or above the first threshold value as a result of the comparison, the processor 130 determines that the audio signal of the first frame is a voice signal.

On the other hand, when the similarity is equal to or above the first threshold value, the processor 130 may determine that the audio signal of the first frame is a signal of an event signal. When it is determined that the audio signal of the first frame is the event signal, the processor 130 analyzes the audio signal of the first frame and extracts the second feature value.

Thereafter, the processor 130 computes a similarity between at least one of the first feature value and the second feature value pre-extracted from the audio signal of the first frame and at least one feature value corresponding to the voice signal pre-stored in the memory 120. Thereafter, the processor 130 compares the pre-computed similarity with the predetermined second threshold value, and when the pre-computed similarity is below the second threshold value, the processor 130 may determine that the audio signal of the first frame is a noise signal, and when the audio signal of the first frame is equal to or above the second threshold value, the processor 130 may determine that the audio signal of the first frame is a voice signal.

When the audio signal of the first frame is an initially input audio signal as aforementioned, the second threshold value may be adjusted to have a same value as the first threshold value.

The electronic device 100 according to the present disclosure may extract only a voice section with respect to an uttered voice of the user from the audio signal input through the aforementioned process.

Meanwhile, according to an additional aspect of the present disclosure, when it is determined that the audio signal of the first frame is a voice signal, the processor 130 may classify the speaker of the audio signal of the first frame based on the first and second feature values extracted from the audio signal of the first frame and the feature value corresponding to the pre-defined voice signal.

More specifically, the feature values corresponding to voice signals stored in the memory 120 may be classified into feature values with respect to voice signals of men and pre-defined feature values with respect to voice signals of women. Therefore, when it is determined that the audio signal of the first frame is a voice signal, the processor 130 may further determine whether the audio signal of the first frame is the voice signal of a man or a woman by comparing the first and second feature values extracted from the audio signal of the first frame and a feature value defined according to gender.

The aforementioned inputter 110 may include the microphone 111, a manipulator 113, a touch inputter 115, and a user inputter 117 as illustrated in FIG. 2.

The microphone 111 may receive a voice uttered by the user or other audio signals generated from the living environment, and may divide the input audio signal into frames of predetermined time units, and output the divided frames to the processor 130.

The manipulator 113 may be realized as a key pad provided with various function keys, number keys, special keys, character keys and the like, and in a case where a display 191 that will be explained later on is realized in a touch screen form, the touch inputter 115 may be realized as a touch pad that constitutes a mutual-layered structure with the display 130. In this case, the touch inputter 115 may receive a touch command with respect to an icon displayed through an outputter 190 that will be explained later on.

The user inputter 117 may receive an IR signal or an RF signal from at least one peripheral device. Therefore, the aforementioned processor 130 may control operations of the electronic device 100 based on the IR signal or the RF signal input through the user inputter 117. In this case, the IR or the RF signal may be a control signal or a voice signal for controlling operations of the electronic device 100.

The electronic device 100 may further include a communicator 140, a voice processor 150, a photographer 160, a sensor 170, a signal processor 180, and the outputter 190 as illustrated in FIG. 2, besides the inputter 110, the memory 120, and the processor 130.

The communicator 140 performs data communication with at least one peripheral device. In an exemplary embodiment, the communicator 140 may transmit a voice signal with respect to an uttered voice of the user to a voice recognition server, and receive a result of voice recognition having a text format received from the voice recognition server. In another embodiment, the communicator 140 may perform data communication with a web server and receive content corresponding to the user command or a search result with respect to the content.

The communicator 140 may include a connector 145 that includes at least one of a wireless communication module 143 such as a short distance communication module 141, wireless LAN module and the like, and a wired communication module such as an High-Definition Multimedia Interface (HDMI), Universal Serial Bus (USB), Institute of Electrical and Electronics Engineers (IEEE) 1394 and the like.

The short distance communication module 141 is a component for performing a wireless short distance communication between a portable terminal device and the electronic device 100. Such a short distance communication module may include at least one of a Bluetooth module, an infrared data association (IrDA) module, a Near Field Communication (NFC) module, a WiFi module, a Zigbee module and the like.

Furthermore, the wireless communication module 143 is a module configured to be connected to an external network to perform communication according to a wireless communication protocol such as IEEE etc. Such a wireless communication module may further include a mobile communication module configured to be connected to a mobile communication network to perform communication according to various mobile communication standards such as 3rd Generation (3G), 3rd Generation Partnership Project (3G99), Long Term Evolution (LTE), and the like.

As such, the communicator 140 may be realized by the various aforementioned short distance communication methods, and other communication techniques not mentioned in the present specification may be adopted as well.

The connector 145 is a configuration providing an interface with various source devices such as USB 2.0, USB 3.0, HDMI, IEEE 1394, and the like. Such a connector 145 may receive contents data transmitted from an external server or transmit pre-stored contents data to an external record medium through a wired cable connected to the connector 145 according to a control command of a controller 130 that will be explained later on. Furthermore, the connector 145 may receive power from a power source through a wired cable physically connected to the connector 145.

The voice processor 150 is a configuration for performing voice recognition with respect to a voice section uttered by the user among the audio signal input through the inputter 110. Specifically, when a voice section is detected from the input audio signal, the voice processor 150 may attenuate noise with respect to the detected voice section, and perform a pre-processing of amplifying the voice section, and then perform voice recognition with respect to the uttered voice of the user using a voice recognition algorithm such as a Speech to Text (STT) algorithm with respect to the amplified voice section.

The photographer 160 is a configuration for photographing a still image or a video according to a user's command, and may be realized as a plurality of photographers including for example a front camera and a rear camera.

The sensor 170 senses various operation states and user interactions of the electronic device 100. Especially, the sensor 170 may sense the user's state of gripping of the electronic device 100. Specifically, the electronic device 100 may be rotated or inclined in various directions. In this case, the sensor 170 may sense a rotation motion or an inclination of the electronic device 100 of the gripping made by the user with respect to a gravity direction using at least one of various sensors including a geomagnetic sensor, gyro sensor, acceleration sensor, and the like.

The signal processor 180 may be a component for processing image data or audio data of contents received through the communicator 140 or stored in the memory 120 according to a control command of the processor 130. Specifically, the signal processor 180 may perform various image processing operations such as decoding, scaling, noise filtering, frame rate conversion, resolution conversion and the like on the image data included in the contents. Furthermore, the signal processor 180 may perform various audio signal processing operations such as decoding, amplifying, noise filtering, and the like on the audio data included in the contents.

The outputter 190 outputs the contents signal-processed through the signal processor 180. Such an outputter 190 may output the contents through at least one of the display 191 and an audio outputter 192. That is, the display 191 may display the image data image-processed by the signal processor 180, and the audio outputter 192 may output the audio data that has been audio-signal-processed in an audible format.

The display 191 that displays the image data may be realized as a liquid crystal display (LCD), organic light emitting display (OLED), or plasma display panel (PDP), and the like. Especially, the display 191 may be realized in a touch screen format that forms a mutual layered structure together with the touch inputter 115.

The aforementioned processor 130 may include a CPU 131, a Read Only Memory (ROM) 132, a Random Access Memory (RAM) 133, and a GPU 135, the CPU 131, the ROM 132, ROM 133, and the GPU 135 being connected though buses 137.

The CPU 131 accesses the memory 120 and performs booting using an OS stored in the memory 120. Furthermore, the CPU 131 performs various operations using various programs, contents and data and the like stored in the storage 120.

In the ROM 132, command sets for booting the system and the like area stored. When a turn-on command is input and power is supplied, the CPU 131 copies the OS stored in the memory 120 according to a command stored in the ROM 132, and executes the OS to boot the system. When the booting is completed, the CPU 131 copies various programs stored in the storage 120 to the RAM 133, and executes the programs copied to the RAM 133 to perform various operations.

The GPU 135 creates a display screen that includes various objects such as an icon, an image, a text, and the like. Specifically, based on a received control command, the GPU 135 computes an attribute value such as a coordinate value, a form, a size, a color, and the like for displaying each of the objects according to a layout of a screen and creates a display screen of various layouts including the object based on the computed attribute value.

Such a processor 130 may be combined with various components such as the aforementioned inputter 110, the communicator 140, the sensor 170, and the like and be realized as a single chip system (System-on-a-chip (SOC) or System on chip (SoC)).

The aforementioned operations of the processor 130 may be performed by a program stored in the memory 120. In this case, the memory 120 may be realized as at least one of the ROM 132, the RAM 133, a memory card (for example, an SD card, a memory stick, and the like) attachable to and detachable from the electronic device 100, a nonvolatile memory, a volatile memory, a hard disk drive (HDD), or a solid state drive (SDD).

Figure 3:
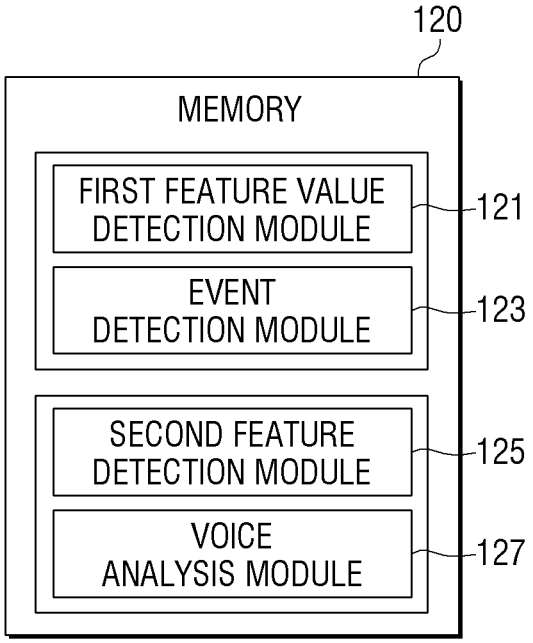
FIG. 3 is a block diagram illustrating a configuration of a memory according to an exemplary embodiment of the present disclosure.

The processor 130 configured to detect a voice section from an audio signal of frame units as aforementioned may be made of a program stored in the memory 120 as illustrated in FIG. 3.

FIG. 3 is a block diagram illustrating a configuration of the memory according to the embodiment of the present disclosure.

As illustrated in FIG. 3, the memory 120 may include a first feature value detection module 121, an event detection module 123, a second feature value detection module 125, and a voice analysis module 127.

In this case, the first feature value detection module 121 and the event detection module 123 may be a module for determining whether or not an audio signal of frame units is an event signal. Furthermore, the second feature value detection module 125 and the voice analysis module 127 may each be a module for determining whether or not an audio signal of frame units detected as an event signal is a voice signal.

Specifically, the first feature value detection module 121 is a module for extracting at least one feature value among an MFCC, Roll-off, and band spectrum energy from an audio signal of frame units. Furthermore, the event detection module 123 may be a module for determining whether or not an audio signal of each frame is an even signal using the first feature value with respect to the audio signal of frame units extracted from the first feature detection module 121. Furthermore, the second feature value detection module 125 is a module for extracting at least one feature value among a Low energy ratio, a Zero crossing rate, a Spectral flux, and an Octave band energy from the audio signal of the frame detected as the event signal. Furthermore, the voice analysis module 127 may be a module for comparing and analyzing the first and second feature value detected from the first and second feature value detection modules 121, 125 and the predetermined feature value corresponding to each of various kinds of signals including a voice signal and determining whether or not the audio signal of the frame where the second feature value is extracted is a voice signal.

Therefore, when an audio signal of the first frame is input, the processor 130 extracts the first feature value from the audio signal of the first frame using the first feature value detection module 121 stored in the memory 120 as aforementioned. Thereafter, the processor 130 may determine a similarity between the first feature value extracted from the audio signal of the first frame and the first feature value extracted from the audio signal of the previous frame using the event detection module 123, and determine whether or not the audio signal of the first frame is an event signal based on a result of the similarity determination.

When it is determined that the audio signal of the first frame is an event signal, the processor 130 extracts a second feature value from the audio signal of the first frame using the second feature value detection module 125. Thereafter, the processor 130 may compare the first and second feature value extracted from the audio signal and the feature value corresponding to the pre-defined voice signal and determine whether or not the audio signal of the first frame is a voice signal.

Figure 4:
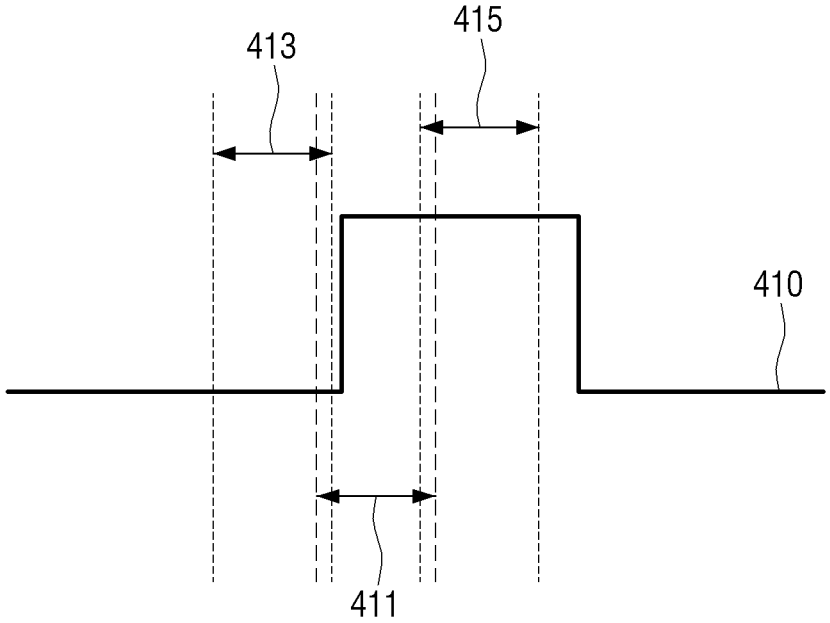
FIG. 4 is an exemplary view illustrating an operation of detecting a voice section from an audio signal according to an exemplary embodiment of the present disclosure.

FIG. 4 is an exemplary view of extracting a voice section from an audio signal 410 according to an exemplary embodiment of the present disclosure.

As illustrated in FIG. 4, the processor 130 may determine whether or not an audio signal of a B frame 411 is a voice signal based on the first and second feature value extracted from the audio signal of the currently input B frame 411 and the audio signal of an A frame 413.

After the audio signal of the B frame 411 is input, an audio signal of a C frame 415 may be sequentially input. In this case, the processor 130 extracts the first feature value from the audio signal of the C frame 415.

Thereafter, the processor 130 determines a similarity between the first feature value extracted from the audio signal of the C frame 415 and the first feature value extracted from the audio signal of the B frame 411. When it is determined that the similarity between the first feature value extracted from the audio signal of the C frame 415 and the first feature value extracted from the audio signal of the B frame 411 is high, the processor 130 may determine that the audio signal of the C frame 415 is a voice signal.

That is, as aforementioned, the audio signal of the B frame 411 input before the audio signal of the C frame 415 is input may be determined as the audio signal. Therefore, when it is determined that the first feature value extracted from the audio signal of the B frame 411 predetermined as the voice signal and the first feature value extracted from the currently input audio signal of the C frame 415 is similar, the processor 130 may determine the audio signal of the C frame 415 as a same voice signal as the audio signal of the B frame 411.

Hereinafter, a computation amount for detecting a voice section from the audio signal input in a conventional electronic device and the electronic device 100 of the present disclosure will be compared and explained.

Figure 5:
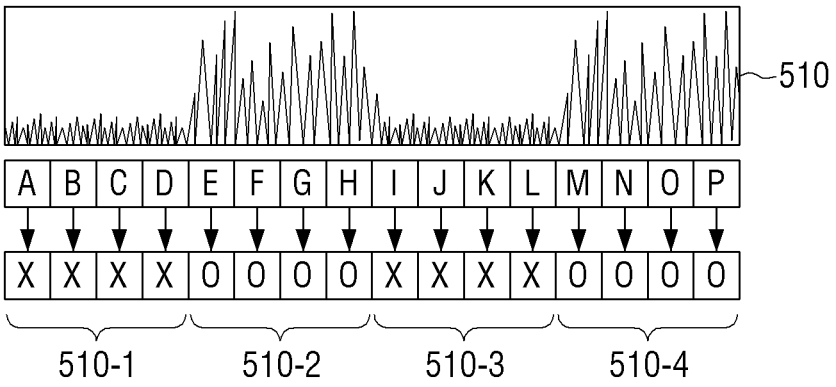
FIG. 5 is an exemplary view illustrating a computation amount necessary for detecting a voice section from an audio signal input into a conventional electronic device.

FIG. 5 is an exemplary view illustrating a computation amount for detecting a voice section from the audio signal input in a conventional electronic device.

As illustrated in FIG. 5, when an audio signal 510 including a voice signal is input, the electronic device 100 divides the input audio signal 510 into frames of time units. Therefore, the input audio signal 510 may be divided into an audio signal of A to P frames. Thereafter, the electronic device 100 extracts a plurality of feature values from the audio signal of A to P frames, and determines whether or not the audio signal of A to P frames is a voice signal based on the extracted plurality of feature values.

That is, the electronic device 100 may extract both the aforementioned first and second feature value from the audio signal of each frame, and determine that a first section 510-1 including the audio signal of the A to D frames and a third section 510-3 including the audio signal of I to L frames as noise sections. Furthermore, the electronic device 100 may extract a feature value from the audio signal of each frame, and determine that a second section 510-2 including the audio signal of E to H frames and a fourth section 510-4 including the audio signal of M to P frames as voice sections.

Figure 6:
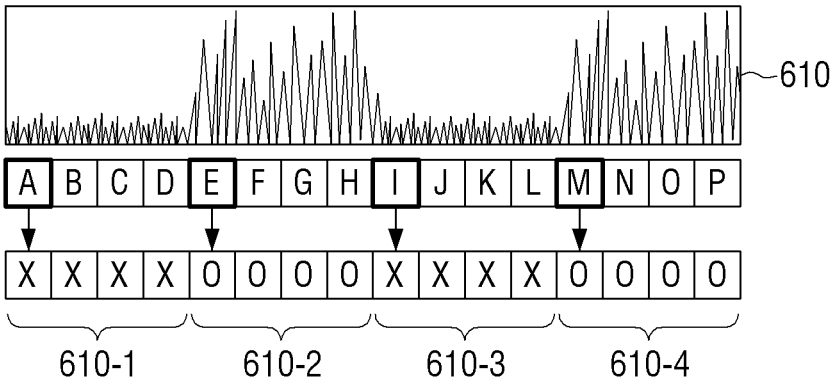
FIG. 6 is an exemplary view illustrating a computation amount necessary for detecting a voice section from an input audio signal according to an exemplary embodiment of the present disclosure.

FIG. 6 is an exemplary view illustrating a computation amount for detecting a voice section from an input audio signal according to an embodiment of the present disclosure.

As illustrated in FIG. 6, when an audio signal 610 including a voice signal is input, the electronic device 100 divides the input audio signal 610 into an audio signal of A to P frames. Thereafter, the electronic device 100 computes a first and a second feature value from an audio signal of an A frame that is a starting frame, and determines whether or not the audio signal of the A frame is a voice signal based on the computed first and second feature value.

When it is determined that the audio signal of the A frame is a noise signal, the electronic device 100 extracts the first feature value from the audio signal of each of the plurality of frames being input after the audio signal of the A frame, and determines a similarity between the first feature values extracted from the audio signal of each frame.

As a result of the determination, the first feature value of the audio signal of B to D frames may have a high similarity with the first feature value extracted from the audio signal of the A frame. In this case, the electronic device 100 may determine that the audio signal of the B to D frames is a noise signal without computing the second feature value for determining whether or not an audio signal is a voice signal from the audio signal of the B to D frames having a similar feature value with the audio signal of the A frame. Therefore, the electronic device 100 may determine a first section 610-1 including the audio signal of the A to D frames as a noise section.

The first feature value extracted from the audio signal of an E frame may have a low similarity with the first feature value extracted from the audio signal of the D frame. In this case, the electronic device 100 extracts the second feature value from the audio signal of the E frame, and determines whether or not the audio signal of the E frame is a voice signal using the extracted first and second feature value.

When it is determined that the audio signal of the E frame is a noise signal, the electronic device 100 extracts the first feature value from the audio signal of each of the plurality of frames input after the audio signal of the E frame, and determines a similarity between the first feature values extracted from the audio signal of each frame.

As a result of the determination, the first feature value of the audio signal of F to H frames may have a high similarity with the first feature value extracted from the audio signal of the E frame. In this case, the electronic device 100 may determine that the audio signal of the F to H frames is a voice signal without computing the second feature value for determining whether or not the audio signal of the F to H frames having a similar feature value with the audio signal of the E frame is a voice signal. Therefore, the electronic device 100 may determine a second section 610-2 that includes the audio signal of the E to H frames as a voice section.

By performing such a series of operations, the electronic device 100 may determine that the first section 610-1 that includes the audio signal of the A to D frames and a third section 610-3 that includes the audio signal of I to L frames as noise sections, and may determine that the second section 610-2 that includes the audio signal of thee E to H frames and a fourth section 610-4 that includes the audio signal of M to P frames as voice sections.

As such, the electronic device 100 according to the present disclosure may compute a plurality of feature values with respect to only the audio signal of a starting frame and a frame where an event occurred, without computing a plurality of feature values from an audio signal of each frame, thereby minimizing a computation amount for computing a feature value from an audio signal per frame compared to a conventional voice detection method.

So far, each of the components of the electronic device where voice recognition is possible according to the present disclosure were explained in detail. Hereinafter, a method for performing voice recognition in the electronic device 100 according to the present disclosure will be explained in detail.

Figure 7:
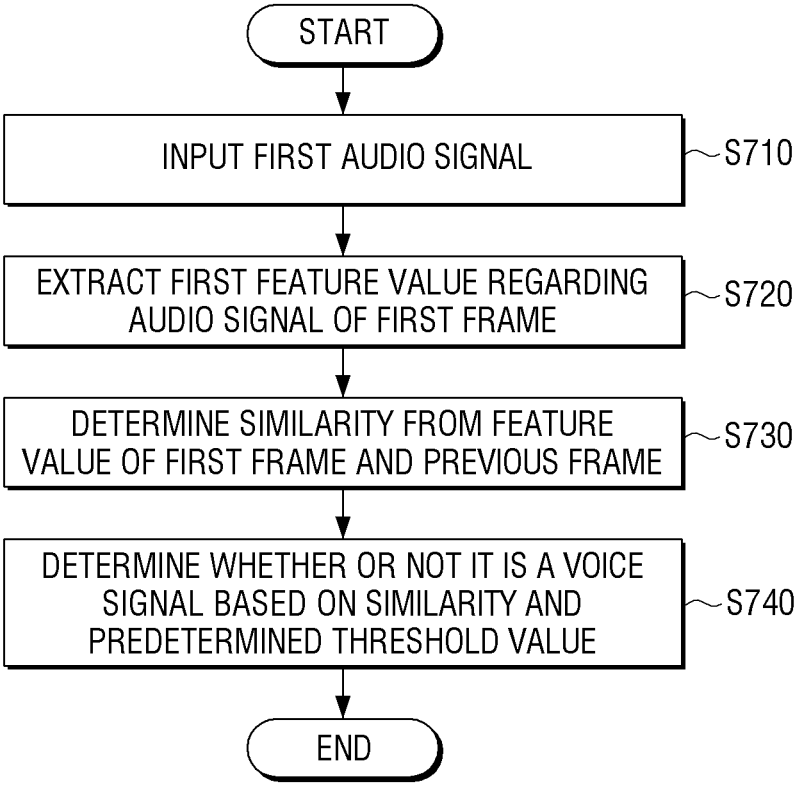
FIG. 7 is a flowchart of a voice recognition method in an electronic device according to an exemplary embodiment of the present disclosure.

FIG. 7 is a flowchart of a voice recognition method in an electronic device according to an exemplary embodiment of the present disclosure.

As illustrated in FIG. 7, when an audio signal of a first frame of an audio signal of frame units is input (S710), the electronic device 100 analyzes the audio signal of the first frame and extracts a first feature value (S720). In this case, the first feature value may be at least one of an MFCC, Centroid, Roll-off, and band spectrum energy.

When the audio signal of the first frame is analyzed and the first feature value is extracted, the electronic device 100 determines a similarity between the first feature value extracted from the audio signal of the first frame and a first feature value extracted from an audio signal of a previous frame (S730). In some embodiments, the electronic device 100 may compute a similarity between the first frame and a previous frame using a cosine similarity algorithm such as the aforementioned <Math Equation 1>. When the similarity between the first frame and the previous frame is computed, the electronic device 100 determines whether the audio signal of the first frame is a voice signal or a noise signal based on the computed similarity and a predetermined threshold value (S740).

Hereinafter, operations for determining whether an audio signal of a frame input into the electronic device is a voice signal or a noise signal according to the present disclosure will be explained in detail.

Figure 8:
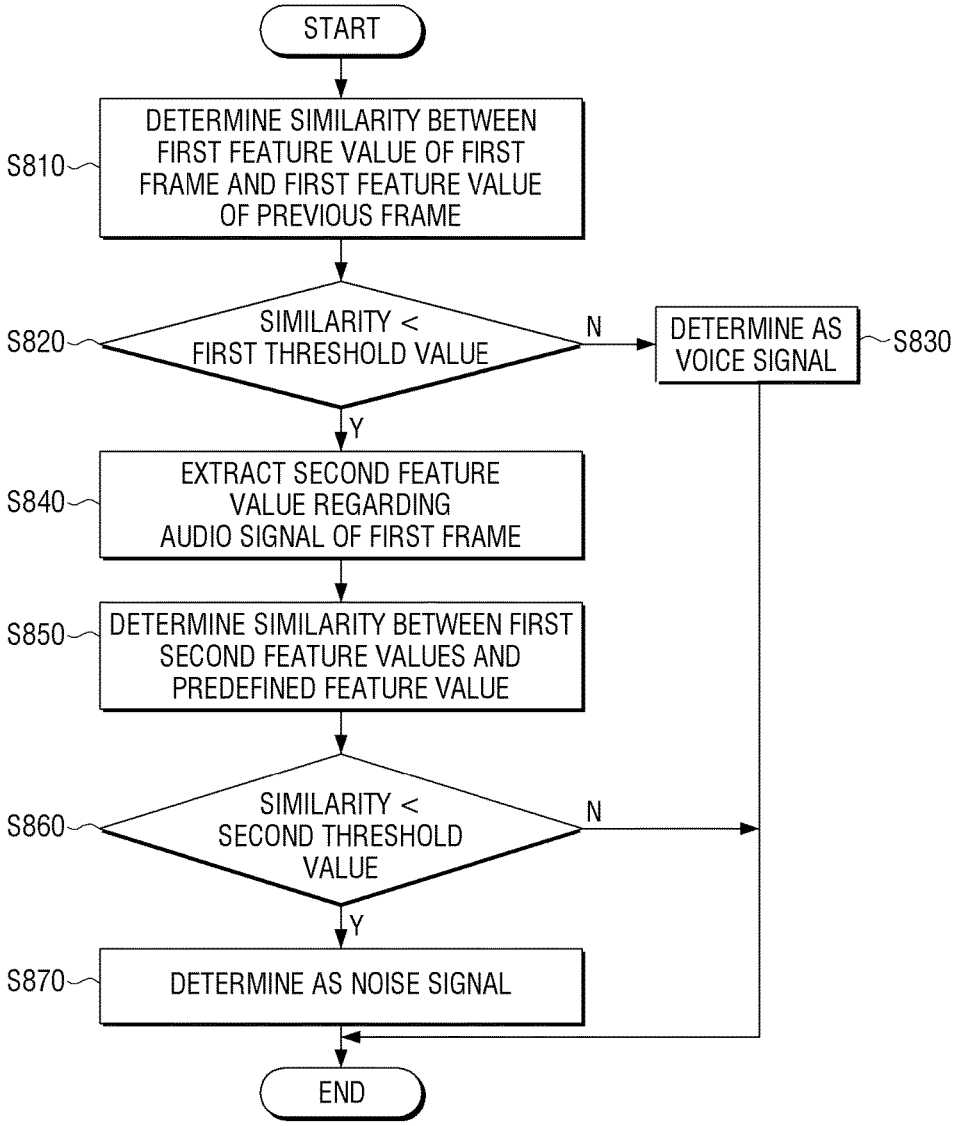
FIG. 8 is a flowchart for determining whether or not an audio signal of a frame input into an electronic device is a voice signal according to an exemplary embodiment of the present disclosure.

FIG. 8 is a first flowchart for determining whether or not an audio signal of a frame input into the electronic device is a voice signal according to an exemplary embodiment of the present disclosure.

An audio signal of a previous frame input before the audio signal of the first frame was input may be a signal detected as a voice signal.

In this case, as illustrated in FIG. 8, the electronic device 100 determines a similarity between the first feature value extracted from the audio signal of the first frame and a first feature value extracted from the audio signal of the previous frame (S810). Specifically, the electronic device 100 may compute the similarity between the first feature value extracted from the audio signal of the first frame and the first feature value of the previous frame using the cosine similarity algorithm such as the aforementioned <Math Equation 1>. As aforementioned, the first feature value extracted from the audio signal of the first frame may be at least one of MFCC, Centroid, Roll-off, and band spectrum energy.

When the similarity between the first feature value extracted from the audio signal of the first frame and the first feature value extracted from the audio signal of the previous frame is computed, the electronic device 100 compares the computed similarity with a predetermined first threshold value (S820). When the computed similarity is equal to or above the predetermined first threshold value as a result of the comparison (NO at S820), the electronic device 100 determines the audio signal of the first frame as a voice signal (S830).

On the other hand, when the similarity between the first frame and the previous frame is below the predetermined first threshold value (YES at S820), the electronic device 100 determines that the audio signal of the first frame is a signal of an event occurred, and analyzes the audio signal of the first frame and extracts a second feature value (S840). In this case, the second feature value may be at least one of Low energy ratio, Zero crossing rate, Spectral flux, and Octave band energy.

Thereafter, the electronic device 100 determines a similarity between at least one of the first feature value and the second feature value extracted from the audio signal of the first frame and at least one feature value corresponding to a pre-stored voice signal (S850). The similarity between at least one of the first feature value and the second feature value extracted from the audio signal of the first frame and at least one feature value corresponding to a pre-stored voice signal may be computed from the aforementioned <Math Equation 1>.

When such a similarity is computed, the electronic device 100 compares the computed similarity with a predetermined second threshold value (S860), and when the similarity is below the predetermined second threshold value (YES at S860), the electronic device 100 determines that the audio signal of the first frame is a noise signal (S870). On the other hand, when the similarity is equal to or above the predetermined second threshold value (NO at S860), the electronic device 100 determines that the audio signal of the first frame is a voice signal.

In this case, the second threshold value may be adjusted according to whether or not the audio signal of the previous is a voice signal. When the audio signal of the previous frame is a voice signal as aforementioned, the second threshold value may be adjusted to have a greater value than the first threshold value.

FIG. 9 is a second flowchart for determining whether or not an audio signal of a frame input is a voice signal in an electronic device according to an exemplary embodiment of the present disclosure.

An audio signal of a previous frame input before an audio signal of a frame was input may be a signal detected as a noise signal.

In this case, as illustrated in FIG. 9, the electronic device 100 determines a similarity between a first feature value extracted from the audio signal of the first frame and a first feature value extracted from an audio signal of a previous frame (S910). Specifically, the electronic device 100 may compute a similarity between the first feature value extracted from the audio signal of the first frame and the first feature value of the previous frame using the cosine similarity algorithm such as the aforementioned <Math Equation 1>. As aforementioned, the first feature value extracted from the audio signal of the first frame may be at least one of MFCC, Centroid, Roll-off, and band spectrum energy.

When the similarity between the first feature value extracted from the audio signal of the first frame and the first feature value extracted from the previous frame is computed, the electronic device 100 compares the computed similarity with the predetermined first threshold value (S920). When the computed similarity is equal to or above the predetermined first threshold value as a result of the comparison (NO at S920), the electronic device 100 determines that the audio signal of the first frame is a noise signal (S930).

On the other hand, when the similarity between the first frame and the previous frame is below the predetermined first threshold value (YES at S920), the electronic device 100 determines that the audio signal of the first frame is a signal of an event occurred, and analyzes the audio signal of the first frame and extracts a second feature value (S940). In this case, the second feature value may be at least one of Low energy ratio, Zero crossing rate, Spectral flux, and Octave band energy.

Thereafter, the electronic device 100 determines a similarity between at least one of the first feature value and the second feature value extracted from the audio signal of the first frame and at least one feature value corresponding to a pre-stored voice signal (S950). The similarity between the at least one of the first feature value and the second feature value extracted from the audio signal of the first frame and at least one feature value corresponding to the pre-stored voice signal may be computed from the aforementioned <Math Equation 1>.

When such a similarity is computed, the electronic device 100 compares the computed similarity with a predetermined second threshold value (S960), and when the similarity is below the predetermined second threshold value, the electronic device 100 determines that the audio signal of the first frame is a noise signal (NO at S960). On the other hand, when the similarity is equal to or above the predetermined second threshold value (NO at S960), the electronic device 100 determines that the audio signal of the first frame is a voice signal (S970).

In this case, the second threshold value may be adjusted depending on whether or not the audio signal of the previous frame is a voice signal. As aforementioned, when the audio signal of the previous frame is a noise signal, the second threshold value may be adjusted to have a same or lower value than the first threshold value.

FIG. 10 is a flowchart for determining whether or not an audio signal of a frame initially input into the electronic device is a voice signal according to an exemplary embodiment of the present disclosure.

An audio signal of a first frame input into the electronic device 100 may be the initially input signal.

In this case, as illustrated in FIG. 10, the electronic device 100 determines a similarity between at least one of the first feature value and the second feature value extracted from the audio signal of the first frame and at least one feature value corresponding to a pre-defined voice signal (S1010).

As aforementioned, the first feature value extracted from the audio signal of the first frame may be at least one of MFCC, Centroid, Roll-off, and band spectrum energy. Furthermore, the second feature value may be at least one of Low energy ratio, Zero crossing rate, Spectral flux, and Octave band energy.

Specifically, the electronic device 100 may compute the similarity between at least one of the first feature value and the second feature value extracted from the audio signal of the first frame and at least one feature value corresponding to the pre-defined voice signal using the cosine similarity algorithm such as the aforementioned <Math Equation 1>.

Thereafter, the electronic device 100 compares the computed similarity with a predetermined first threshold value (S1020). As a result of the comparison, when the similarity is below the predetermined first threshold value (YES at S1020), the electronic device 100 determines the audio signal of the first frame as a noise signal (S1040). On the other hand, when the computed similarity is equal to or above the predetermined first threshold value (NO at S1020), the electronic device 100 determines the audio signal of the first frame as a voice signal (S1030).

The aforementioned method of recognizing voice in the electronic device 100 may be realized as at least one execution program configured to perform the aforementioned voice recognition, and such an execution program may be stored in a non-transitory computer readable medium.

A non-transitory readable medium refers to a medium that is readable by a device and that is configured to store data semi-permanently, unlike a medium that stores data for a short period of time such as a register, cache, memory, and the like. Specifically, the aforementioned programs may be stored in various types of terminal-readable record media such as a RAM, flash memory, ROM, Erasable Programmable ROM (EPROM), Electronically Erasable and Programmable ROM (EEPROM), register, hard disk, removable disk, memory card, USB memory, CD-ROM, and the like.

So far, explanation was made on the present disclosure with the main focus on several exemplary embodiments thereof.

The foregoing exemplary embodiments and advantages are merely exemplary and are not to be construed as limiting the present disclosure. The present teaching can be readily applied to other types of apparatuses. Also, the description of the exemplary embodiments of the present disclosure are intended to be illustrative, and not to limit the scope of the claims, and many alternatives, modifications, and variations will be apparent to those skilled in the art.

What is claimed is:

1. A voice recognition method of an electronic device, the method comprising:

analyzing an audio signal of a first frame based on the audio signal of the first frame being input into the electronic device using an inputter of the electronic device, and extracting a first feature value from the audio signal of the first frame using a processor of the electronic device;

determining a similarity between the first feature value extracted from the audio signal of the first frame and a first feature value extracted from an audio signal of a previous frame using the processor;

determining, based on the similarity being equal to or above a predetermined threshold value, a type of the audio signal of the first frame is same as a type of the audio signal of the previous frame;

extracting, based on the similarity being below the predetermined threshold value, a second feature value from the audio signal of the first frame using the processor;

comparing the first feature value and the second feature value extracted from the audio signal of the first frame with at least one feature value corresponding to a pre-defined voice signal;

determining whether or not the audio signal of the first frame is a voice signal using the processor, based on the comparing; and performing voice recognition on the first frame based on the audio signal of the first frame being the voice signal.

2. The method according to claim 1, wherein the audio signal of the previous frame is a voice signal, and the determining whether or not the audio signal of the first frame is a voice signal involves determining that the audio signal of the first frame is a voice signal when the similarity between the first feature value of the first frame and the first feature value of the previous frame is equal to or above a predetermined first threshold value.

3. The method according to claim 2, wherein the determining whether or not the audio signal of the first frame is a voice signal comprises:

comparing a similarity between at least one of the first feature value and the second feature value and at least one feature value corresponding to the pre-defined voice signal with a predetermined second threshold value using the processor, when the similarity between the first feature value of the first frame and the first feature value of the previous frame is below the predetermined first threshold value; and determining that the audio signal of the first frame is a noise signal when the similarity is below the predetermined second threshold value, wherein the predetermined second threshold value is adjusted depending on whether or not the audio signal of the previous frame is a voice signal.

4. The method according to claim 1, wherein the audio signal of the previous frame is a noise signal, and the determining whether or not the audio signal of the first frame is a voice signal involves determining that the audio signal of the first frame is a noise signal when the similarity between the first feature value of the first frame and the first feature value of the previous frame is equal to or above the predetermined first threshold value.

5. The method according to claim 4, wherein the determining whether or not the audio signal of the first frame is a voice signal comprises:

comparing the similarity between at least one of the first feature value and the second feature value and at least one feature value corresponding to the pre-defined voice signal with a predetermined second threshold value using the processor when the similarity between the first feature value of the first frame and the first feature value of the previous frame is below the predetermined first threshold value; and determining that the audio signal of the first frame is a voice signal when the similarity is equal to or above the predetermined second threshold value, and wherein the predetermined second threshold value is adjusted according to whether or not the audio signal of the previous frame is a voice signal.

6. The method according to claim 1, wherein the determining whether or not the audio signal of the first frame is a voice signal involves, when the audio signal of the first frame is an initially input audio signal, computing a similarity between at least one of the first feature value and the second feature value of the first frame and at least one feature value corresponding to the pre-defined voice signal using the processor, and comparing the computed similarity with a predetermined first threshold value using the processor, and when the similarity is equal to or above the predetermined first threshold value, determining the first frame as a voice signal.

7. The method according to claim 1, wherein the first feature value is at least one of Mel-Frequency Cepstral Coefficients, Roll-off, and band spectrum energy.

8. The method according to claim 1, wherein the second feature value is at least one of Low energy ratio, Zero crossing rate, Spectral flux, and Octave band energy.

9. The method according to claim 1, wherein the determining whether or not the audio signal of the first frame is a voice signal involves, when it is determined that the audio signal of the first frame is a voice signal, classifying a speaker with respect to the audio signal of the first frame based on the first feature value and the second feature value and a feature value corresponding to a pre-defined voice signal.

10. An electronic device capable of voice recognition, the device comprising:

an inputter configured to receive an input of an audio signal;

a memory configured to store at least one feature value corresponding to a pre-defined voice signal; and a processor configured to:

based on an audio signal of a first frame being input, analyze the audio signal of the first frame and extract a first feature value from the audio signal of the first frame from the audio signal of the first frame;

determine a similarity between the first feature value extracted from the audio signal of the first frame and a first feature value extracted from an audio signal of a previous frame;

based on the similarity being equal to or above a predetermined threshold value, determine a type of the audio signal of the first frame is same as a type of the audio signal of the previous frame;

based on the similarity being below the predetermined threshold value, extract a second feature value from the audio signal of the first frame;

compare the first feature value and the second feature value extracted from the audio signal of the first frame with a feature value corresponding to a voice signal stored in the memory and determine whether or not the audio signal of the first frame is a voice signal based on the comparison; and perform voice recognition on the first frame based on the audio signal of the first frame being the voice signal.

11. The electronic device according to claim 10, wherein the audio signal of the previous frame is a voice signal, and the processor determines that the audio signal of the first frame is a voice signal when the similarity between the first feature value of the first frame and the first feature value of the previous frame is equal to or above a predetermined first threshold value.

12. The electronic device according to claim 11, wherein, when the similarity between the first feature value of the first frame and the first feature value of the previous frame is below the predetermined first threshold value, the processor compares a similarity between at least one of the first feature value and the second feature value and at least one feature value corresponding to the pre-defined voice signal with a predetermined second threshold value, and when the similarity is below the predetermined second threshold value, the processor determines that the audio signal of the first frame is a noise signal, and the second threshold value is adjusted depending on whether or not the audio signal of the previous frame is a voice signal.

13. The electronic device according to claim 10, wherein the audio signal of the previous frame is a noise signal, and the processor determines that the audio signal of the first frame is a noise signal when the similarity between the first feature value of the first frame and the first feature of the previous frame is equal to or above a predetermined first threshold value.

14. The electronic device according to claim 13, wherein, when the similarity between the first feature value of the first frame and the first feature of the previous frame is below the predetermined first threshold value, the processor compares a similarity between at least one of the first feature value and the second feature value and at least one feature value corresponding to a pre-defined voice signal with a predetermined second threshold value, and when the similarity is equal to or above the predetermined second threshold value, determines that the audio signal of the first frame is a voice signal, and the predetermined second threshold value is adjusted depending on whether or not the audio signal of the previous frame is a voice signal.

15. The electronic device according to claim 10, wherein the processor, when the audio signal of the first frame is an initially input audio signal, computes a similarity between at least one of the first feature value and the second feature value of the first frame and at least one feature value corresponding to the voice signal, and compares the computed similarity with a predetermined first threshold value, and when the similarity is equal to or above the predetermined first threshold value, determines the first frame as a voice signal.

16. The electronic device according to claim 10, wherein the first feature value is at least one of Mel-Frequency Cepstral Coefficients, Roll-off, and band spectrum energy.

17. The electronic device according to claim 10, wherein the second feature value is at least one of Low energy ratio, Zero crossing rate, Spectral flux, and Octave band energy.

18. The electronic device according to claim 10, wherein, when it is determined that the audio signal of the first frame is a voice signal, the processor classifies a speaker with respect to the audio signal of the first frame based on the first feature value and the second feature value and a feature value corresponding to a pre-defined voice signal.

19. A non-transitory computer program combined with an electronic device and stored in a record medium in order to execute steps of:

analyzing an audio signal of a first frame based on the audio signal of the first frame being input into the electronic device using an inputter of the electronic device, and extracting a first feature value using a processor of the electronic device;

determining a similarity between the first feature value extracted from the audio signal of the first frame and a first feature value extracted from an audio signal of a previous frame using the processor;

analyzing the audio signal of the first frame and extracting a second feature value from the audio signal of the first frame based on the similarity being below a predetermined threshold value using the processor;

comparing the first feature value and the second feature value extracted from the audio signal of the first frame with a feature value corresponding to a pre-defined voice signal, and determining whether or not the audio signal of the first frame is a voice signal using the processor, based on the comparing; and performing voice recognition on the first frame based on the audio signal of the first frame being the voice signal.

* * * * *